US006149491A

United States Patent [19]

Arad et al.

[11] Patent Number: 6,149,491

[45] Date of Patent: Nov. 21, 2000

[54] SELF-PROPELLED DOLL RESPONSIVE TO SOUND

[75] Inventors: Abraham A. Arad, Westport, Conn.; Janos Beny, Vista, Calif.

[73] Assignee: Marvel Enterprises, Inc., New York, N.Y.

[21] Appl. No.: 09/114,366

[22] Filed: Jul. 14, 1998

[51] Int. Cl.[7] ..... A63H 11/18

[52] U.S. Cl. ..... 446/355; 446/354; 446/175

[58] Field of Search ..... 446/175, 325, 446/354, 377, 384, 355

[56] References Cited

U.S. PATENT DOCUMENTS

| | | | |
|---|---|---|---|
| 3,648,405 | 3/1972 | Tepper . | |
| 3,660,931 | 5/1972 | Gardel et al. | 446/355 |
| 3,775,900 | 12/1973 | Thorn et al. | 446/354 |
| 3,949,521 | 4/1976 | Heerlein . | |
| 4,067,138 | 1/1978 | Cederholm et al. . | |
| 4,073,088 | 2/1978 | Beny et al. | 446/354 |
| 4,613,315 | 9/1986 | Kataoka | 446/355 |
| 4,795,395 | 1/1989 | Oishi et al. | 446/355 X |
| 4,944,708 | 7/1990 | Kawabe | 446/355 X |
| 5,030,161 | 7/1991 | Pastor | 446/298 |
| 5,045,015 | 9/1991 | Arad et al. | 446/355 |
| 5,224,896 | 7/1993 | Terzian | 446/355 |
| 5,238,441 | 8/1993 | Llorens | 446/355 X |
| 5,695,382 | 12/1997 | Lin | 446/354 |

FOREIGN PATENT DOCUMENTS

| | | | |
|---|---|---|---|
| 2272700 | 1/1976 | France | 446/325 |

*Primary Examiner*—John A. Ricci

*Attorney, Agent, or Firm*—Wolf, Block, Schorr and Solis-Cohen LLP; Kenneth R. De Rosa

[57] ABSTRACT

A doll includes a body and a head, two legs and two arms, each movably attached to the body. The doll includes a mechanism connected with the head, with each of the legs, and with the arms. The mechanism is configured to displace the legs frontwardly with respect to the body in alternating succession and to displace the head in lateral directions with respect to the body such that the head moves toward one lateral side of the body as one of the legs displaces frontwardly from the opposite lateral side of the body. Movement of the legs displaces the body of the doll in either a walking or a crawling mode. Further, a motor is connected with the mechanism to drive the mechanism to displace the legs, arms and head with respect to the body. An electrical circuit is connected with the motor and has a microphone. The circuit is configured to drive the motor when the microphone receives sound, particularly a user-generated command. Preferably, the circuit includes an integrated circuit chip configured to drive the motor for a randomly specified period of time. The mechanism preferably includes a gear train having an input end connected with the motor and output ends connected with the legs, the arms and the head. Further, the mechanism preferably includes several separate linkages connected with the legs, the arms and the head, each linkage pivoting the associated appendages or the head with respect to the body.

14 Claims, 9 Drawing Sheets

SELF-PROPELLED DOLL RESPONSIVE TO SOUND

BACKGROUND OF THE INVENTION

The present invention relates to toy dolls, and more particularly, to toy dolls having a mechanism(s) to displace the doll in a walking and/or crawling mode.

Mechanical dolls having mechanisms for enabling the doll to be "self-propelled" (i.e., able to walk or crawl by its own action) are known. For example, U.S. Pat. No. 3,949,521 of Heerlein, U.S. Pat. No. 4,067,138 of Cedeholm et al., U.S. Pat. No. 4,613,315 of Kataoka and U.S. Pat. No. 5,030,161 of Pastor each disclose a doll having one or more mechanisms for moving portions of the doll so as to cause the doll to walk or crawl across a surface. Cedeholm et al., for example, disclose a doll having legs pivotally mounted to a body and including a pneumatic mechanism with bellows that inflate pockets within the legs. By alternately inflating and deflating the leg pockets, the legs are pivoted about the body so as to displace the doll in a walking action.

Further, mechanical dolls having gearing and/or linkage mechanisms to effect relative movement between portions of the doll so as to displace the doll in a walking and/or crawling motion are also known. For example, Pastor discloses a walking doll having a mechanism including both a gear train and a linkage mechanism which pivots both the arms and the legs of the doll with respect to the body such that the doll is pushed forward by the legs and simultaneously pulled forward by the arms. However, the doll disclosed in Pastor is only capable of displacing in a crawling mode that requires all four appendages for movement and cannot "walk" in an upright position, Kataoka discloses a doll having gears and linkages that pivot the lower portion of the doll with respect to the upper portion such that a "wagging" motion is created. The wagging movement of the doll causes the doll to either walk or crawl across a surface; however, the upper portion of the doll must be externally supported in the walking mode or else it will fall over.

Furthermore, dolls having mechanisms for rotating its head relative to its body are also known, such as the doll disclosed in U.S. Pat. No. 3,648,405 of Tepper. Tepper discloses a doll having a gear train that moves the upper torso of the doll with respect to its lower torso and which simultaneously rotates the head about the upper torso.

Although mechanical dolls having mechanisms for moving the legs and/or arms of the doll with respect to its body so as to create walking and/or crawling movement of the doll are known, none of these known dolls are capable of walking without external support. Therefore, from the foregoing, it will be appreciated that it would be desirable to provide a mechanical doll having the ability to effect an unsupported walking motion. It would also be desirable to have a doll that can walk or crawl when prompted by a user of the doll. Further, it is also desirable to provide a doll that moves several of its body portions simultaneously during a walking or crawling movement so as to create a more realistic impression of a human baby or toddler.

SUMMARY OF THE INVENTION

In one aspect, the present invention is a doll comprising a body having a frontward side and first and second lateral sides and a head movably attached to the body. A first leg is movably attached to the body proximal to the first lateral side of the body and a second leg is movably attached to the body proximal to the second lateral side of the body. A mechanism is connected with the head and with each of the legs and is configured to displace the legs frontwardly with respect to the body in alternating succession. The mechanism is further configured to displace the head in lateral directions with respect to the body such that the head moves toward one of the lateral sides of the body as one of the legs displaces frontwardly from proximal the opposite lateral side of the body.

In another aspect, the present invention is a doll movable in response to sounds generated by a user. The doll comprises a body and at least one appendage movably attached to and configured to displace the body. A mechanism is connected with the appendage and is configured to displace the appendage with the respect to the body. An electrical circuit is electrically connected with the mechanism and has a microphone. The circuit is configured to drive the mechanism in response to a sound received by the microphone such that the mechanism displaces the appendage with respect to the body to cause the appendage to displace the body.

In yet another aspect, the present invention is a doll comprising a body and at least one appendage movably attached to the body. A gear train has an input end and at least one output end connected with the appendage. A motor has a motor shaft connected with the input end of the gear train. An electrical circuit is electrically connected with the motor, has a microphone and is configured to drive the motor when the user produces a sound such that the appendage is displaced with respect to the body.

In yet a further aspect, the present invention is a doll comprising a body and a head movably connected with the body. A first rotatable shaft is connected with the body. A cam is mounted to the first shaft and has a cylindrical body, the body having an outer surface and an annular opening defining a cam surface. A movable follower has a first end contactable with the cam surface and a second end connected with the head of the doll such that rotation of the first shaft causes the head to move with respect to the body.

In an even further aspect, the present invention is a doll comprising a body and a rotatable drive shaft connected with the body, a cam being mounted to the drive shaft. A rotatable arm shaft is connected with the body and at least one arm is mounted to the arm shaft. A follower is mounted to the arm shaft and has a first end contactable with the cam such that rotation of the drive shaft causes the follower to pivot the arm in alternating directions with respect to the body.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments which are presently preferred. It should be understood, however, that the invention is not limited to the precise arrangements and instrumentalities shown. In the drawings.

DETAILED DESCRIPTION OF THE INVENTION

Figure 1:
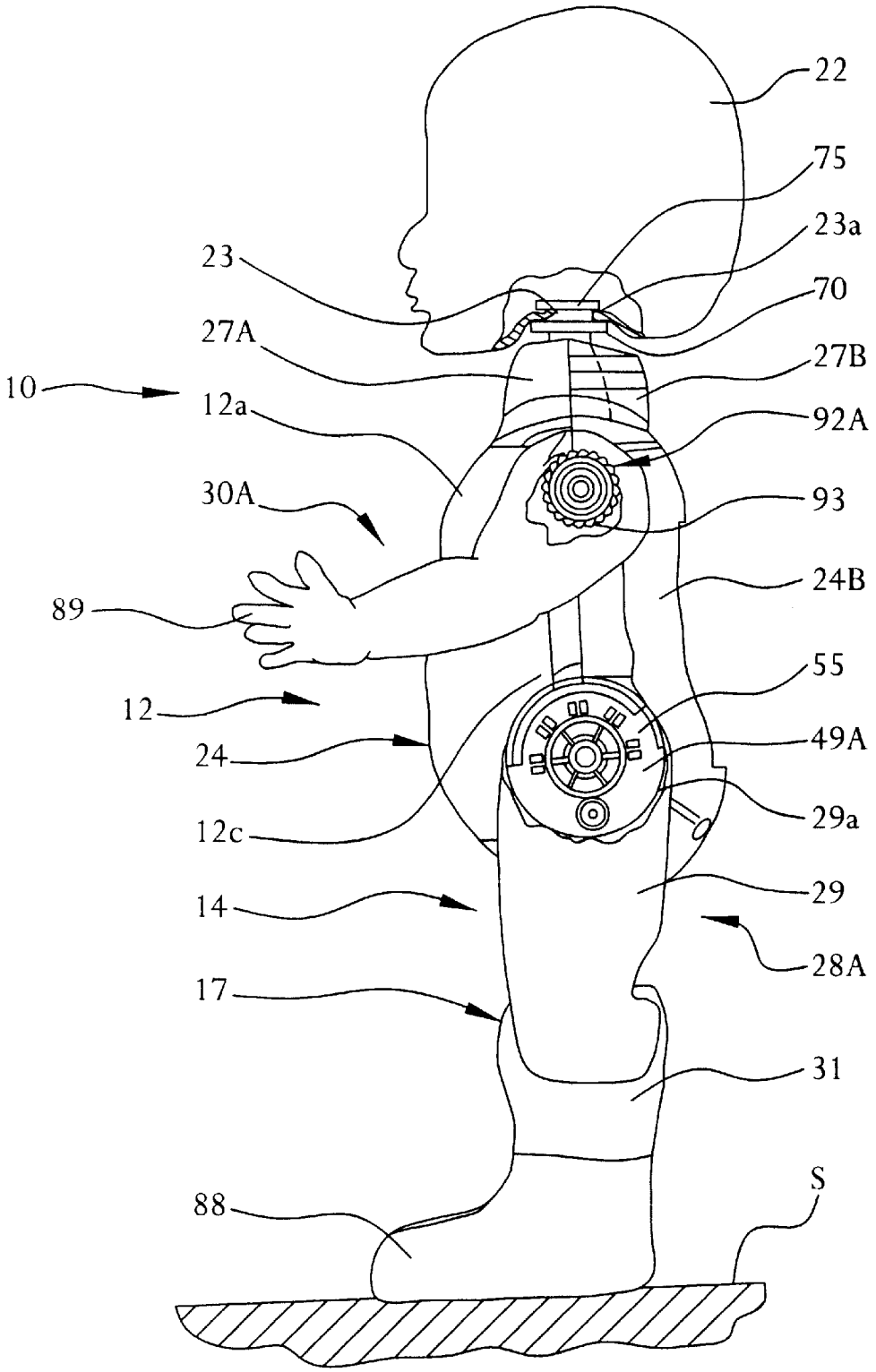
FIG. 1 is a partially broken-away, side elevational view of a self-propelled doll of the present invention shown in a standing configuration.

Certain terminology is used and the following description for convenience only and is not limiting. The words "right", "left", "lower", "upper", "upward", "down" and "downward" designate directions in the drawings to which reference is made. The words "front", "frontward", "rear" and "rearward" refer to directions toward and away from, respectively, either a designated front section of the doll or a specific portion thereof, the particular meaning intended being readily apparent from the context of the description. The words "inner", "inward", "outer" and "outward" refer to directions toward and away from, respectively, the geometric center of either the doll or a particular portion of the doll as will be apparent from the context of the description. The terminology includes the words above specifically mentioned, derivatives thereof, and words of similar import.

Referring now to the drawings in detail, wherein like numerals are used to indicate like elements throughout, there is shown in FIGS. 1–14 a presently preferred embodiment of a self-propelled mechanical doll 10. The doll 10 comprises a body 12, at least one appendage 14 moveably attached to the body 12 and a primary mechanism 16 connected with the appendage 14. The mechanism 16 is configured to displace the appendage 14 with respect to the body 12 such that the appendage 14 displaces the doll 10, as described below. Further, an electrical circuit 18 is electrically connected with the mechanism 16. The circuit 18 has a microphone 20 and is configured to drive the mechanism 16 in response to a sound received by the microphone 20.

Preferably, the doll 10 includes at least two movable appendages 14, most preferably two legs 28A, 28B, and a head 22, each movably connected with the body 12. The primary mechanism 16 is configured to displace the legs 28A, 28B and the head 22 with respect to the body 12. The doll 10 further comprises a motor 32 connected with the electrical circuit 18 and with the mechanism 16. The motor 32 drives the primary mechanism 16 to displace the legs 28A, 28B and the head 22. Each of the above-described basic elements of the doll 10 is described in further detail below.

Referring now to FIGS. 1–5, the body 12 of the doll 10 preferably includes a torso 24 having a frontward side 12*a*, a rearward side 12*b* and first and second lateral sides 12*c*, 12*d*, respectively. The torso 24 is preferably formed of front and rear torso halves 25A, 25B enclosing an interior cavity 26 within which is disposed the primary mechanism 16, as described below. Each torso half 25A, 25B includes a neck portion 27A, 27B, respectively, at an upper end thereof having a top cut-out portion that, when the torso halves 25A, 25B are aligned, form a neck opening 12*e* through which a portion of the mechanism 16 extends so as to be connected with the head 22. Further, each torso half 25A, 25B also includes a pair of laterally-spaced upper cut-out portions and a pair of laterally-spaced lower cut-out portions that, when the torso halves 25A, 25B are aligned, form arm openings 21 and leg openings 23 to enable a pair of arms 30A, 30B and the legs 28A, 28B to be connected with the body 12 as described below. Preferably, the two torso halves 25A, 25B are joined together by threaded fasteners (not shown), although alternatively, the torso halves 25A, 25B may be joined together by rivets, an adhesive substance, interlocking portions or by any other appropriate means.

Figure 3:
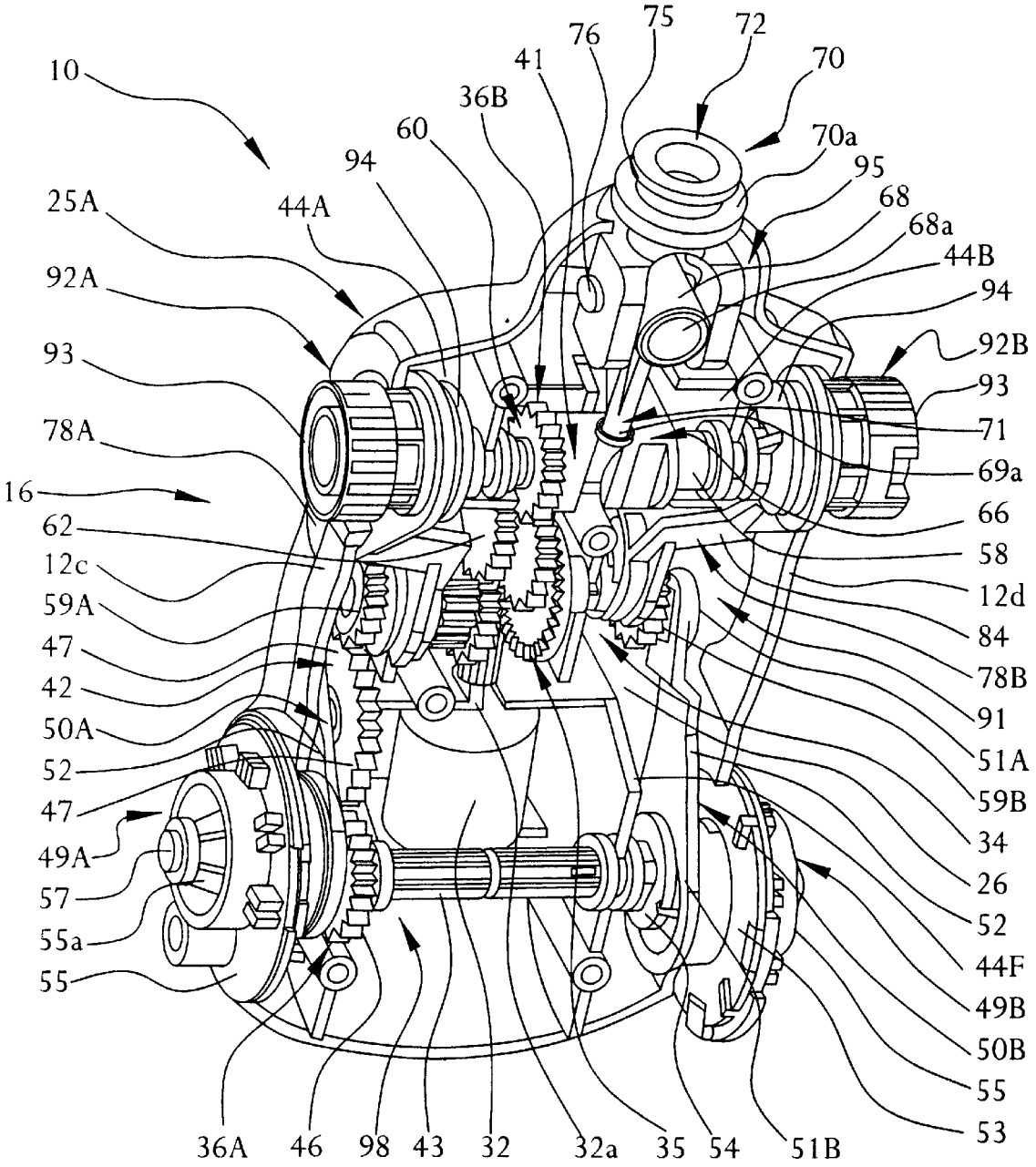
FIG. 3 is a rear perspective view of the front torso half of the doll showing the mechanism for propelling the doll.
Figure 4:
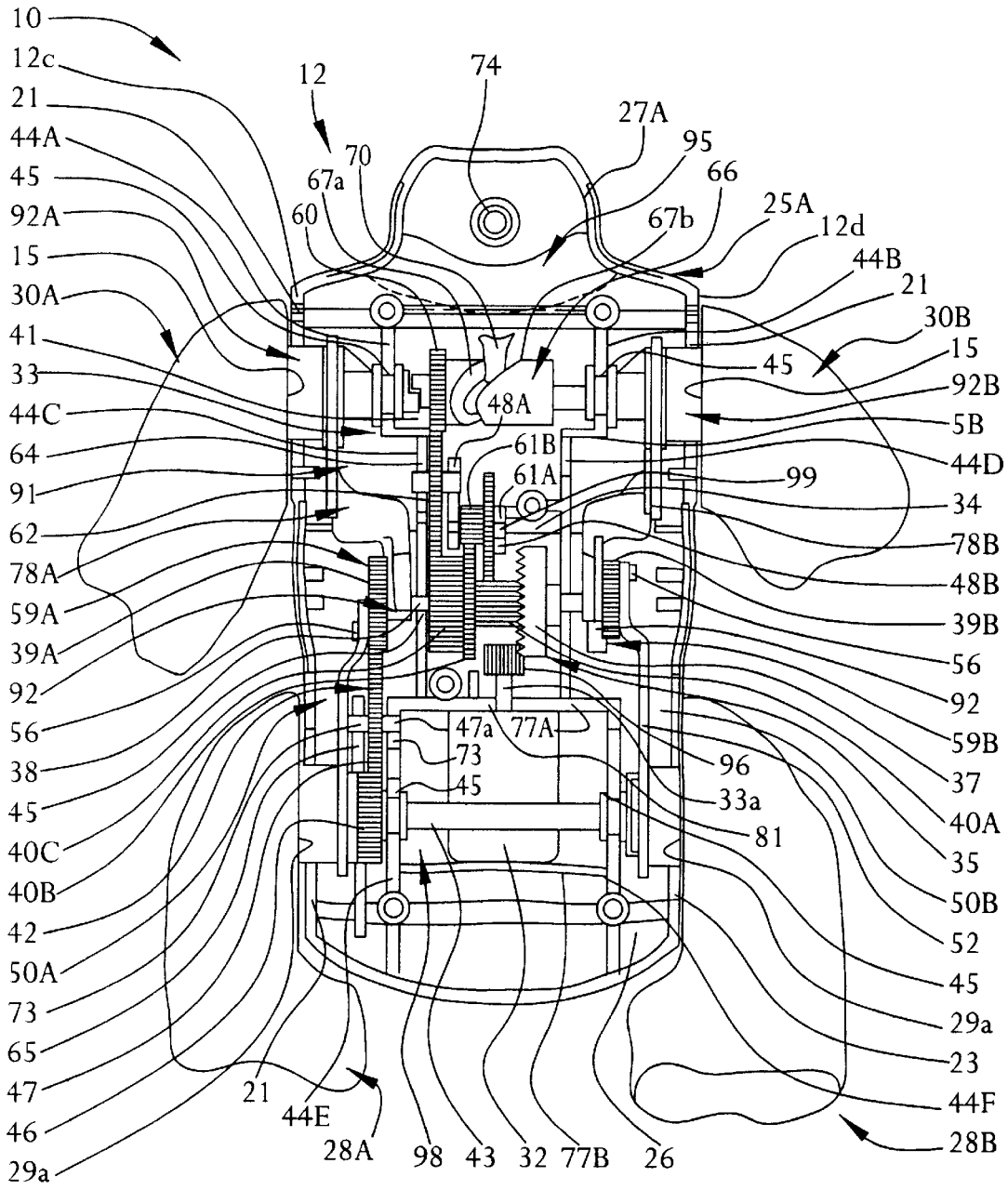
FIG. 4 is a partially broken-away rear plan view or the doll shown with the rear torso half removed.

Referring now to FIGS. 3 and 4, the body 12 preferably includes a support structure 33 disposed within the interior cavity 26 for supporting the mechanism 16 within the doll 10. Preferably, the support structure 33 is formed of a plurality of walls extending from and integral with the inner surface of the front torso half 25A. More specifically, the support structure 33 preferably includes three pairs of longitudinally-extending shaft-support walls; an upper pair of walls 44A, 44B, a middle pair of walls 44C, 44D and a lower pair of walls 44E, 44F, each shaft-support wall (e.g., 44A) being generally parallel with the other wall (e.g., 44B) of the particular pair. Each shaft-support wall 44A–44F has a bearing opening 45 that is aligned with another bearing opening 45 in the corresponding support wall 44A–44F, such that three pairs of aligned bearing openings 45 are provided. An inner pair of longitudinally-extending, generally parallel gear-support walls 48A, 48B is disposed between the middle pair of shaft-support walls 44C, 44D and each gear-support wall 48A, 48B includes a bearing opening 49 aligned with the bearing opening 49 in the other wall 48B, 48A. The left gear-support wall 48A further includes a second bearing opening 64 aligned with a second bearing opening 64 in the left, middle shaft-support wall 44C.

Still referring to FIGS. 3 and 4, the support structure 33 preferably further includes an outer gear-support wall 65 that extends generally longitudinally and parallel with the left, lower shaft-support wall 44E. The outer gear-support wall 65 has a bearing opening 73 aligned with a second bearing opening 73 in the shaft-support wall 44E. A pair of motor support walls 77A, 77B extend laterally between the lower pair of shaft support walls 44E, 44F and are spaced such that the casing of a preferred type of motor 32 fits generally tightly between the upper wall 77A and the lower wall 77B. Preferably, a shaft 81 opening extends through the upper wall to provide clearance for a shaft 32*a* of the motor 32, as described below.

Although the above-described construction of the support structure 33 is preferred, it is within the scope of the present invention to construct the support structure 33 in any other manner which enables the primary mechanism 16 to be connected with the doll 10 and to move at least one appendage 14 with respect to the body 12. For example, the support structure 33 may be provided by pairs of individual brackets of any suitable type located at appropriate locations internally or externally of the torso 24. Further, a cover member (not shown) is preferably removably disposed against the outer, free ends of the support walls to retain the mechanism 16 onto the support structure 33, as described in detail below.

Figure 5:
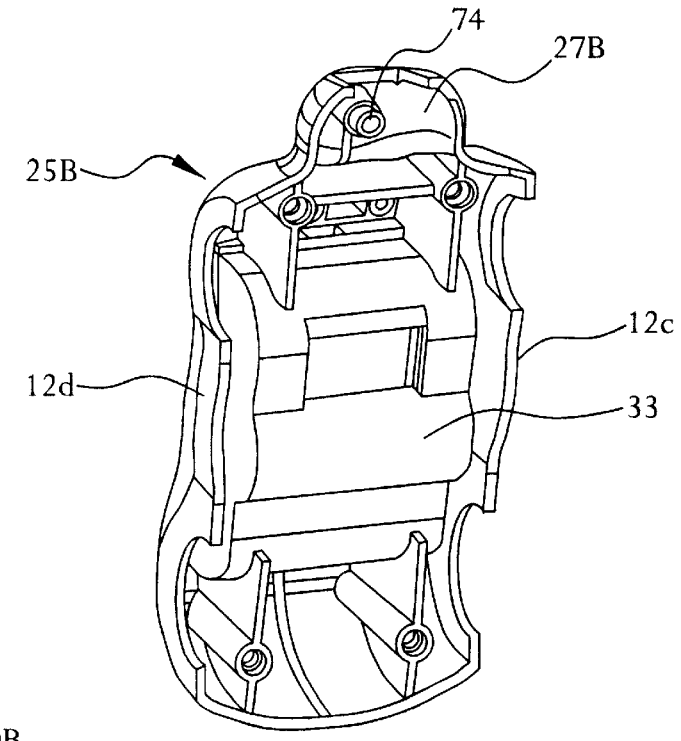
FIG. 5 is a front perspective view of the rear torso half.

Referring specifically to FIG. 5, the body 12 of the doll 10 further includes a power supply compartment 13 to house an appropriate source of electrical power 11 (shown only diagrammatically in FIG. 14) for driving the mechanism 16, as described below. Most preferably, the power supply compartment 13 is constructed as a generally rectangular open box extending inwardly from and integrally formed with the rear torso half 25B and includes a cover (not shown) to enclose the compartment 13. Preferably, the power supply compartment is configured to hold three "C" size batteries (none shown), the preferred power source 11 for the electrical circuit 18, as described below. Alternatively, the power source 11 may be several "double-A" type batteries, any number of another appropriate type of battery, or even connection means, such as a cord or socket, to connect the mechanism 16 with a source of alternating current, such as a standard household power outlet. Further, the power supply compartment 13 may alternatively be constructed in any other appropriate manner and located at another convenient location, either internally or externally, on the body 12, or may even be eliminated from the doll 10 if the doll 10 is constructed to utilize another type of power source.

Figure 2:
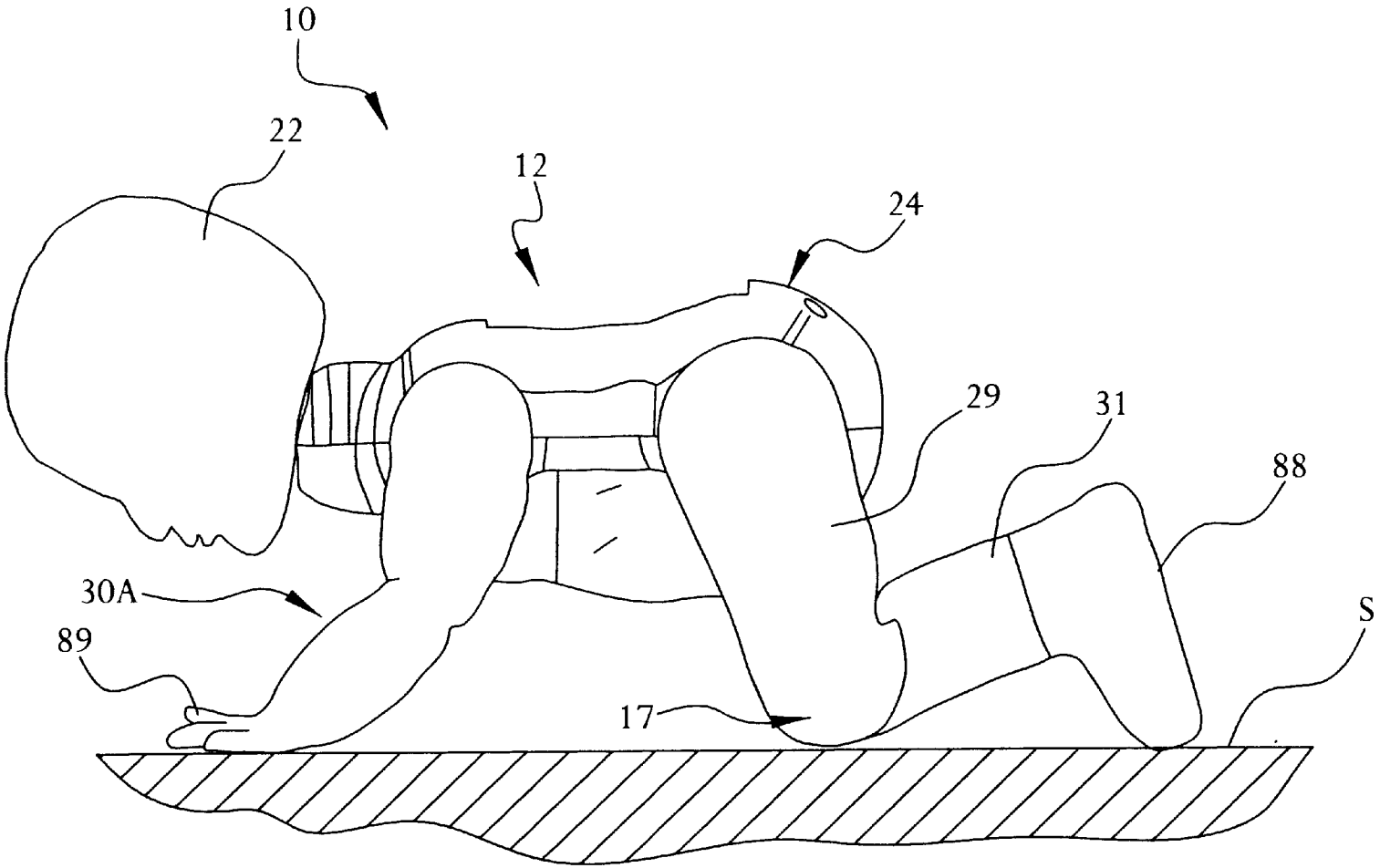
FIG. 2 side elevational view of the doll shown in a crawling configuration.

Referring now to FIGS. 1, 2 and 4, as discussed above, the doll 10 includes a first leg 28A moveably attached to the body 12 proximal to the first lateral side 12*c* of the body 12 and a second leg 28B moveably attached to the body 12 proximal to the second lateral side 12*d* of the body 12. Each leg 28A, 28B is preferably attached to the torso 24 at a separate leg opening 23 so as to be connected with the primary mechanism 16, as described below. Further, each leg 28A, 28B is preferably formed of an upper leg portion 29 pivotally connected to a lower leg portion 31 by appropriate means, such as for example, by a shaft pin or an appropriate type of hinge (neither shown), forming a knee portion 17. The upper portion 29 of each leg 28A, 28B includes an opening 29*a* configured for connecting the legs 28A, 28B to the mechanism 16 as described below. Further, each lower leg portion 31 terminates in a foot 88, each foot 88 preferably having sufficient surface area such that the body 12 of the doll 10 can be balanced thereon, as described below.

By having legs 28A, 28B that are each formed of two portions, the legs 28A, 28B are foldable to enable the doll 10 to displace in either of two configurations. The doll are displaces in either a walking mode when the legs 28A, 28B disposed in a first, generally straight configuration (FIG. 1) and in a crawling mode when the legs 28A, 28B are disposed in a second, "bended" configuration (FIG. 2), as described in detail below.

Still referring to FIGS. 1, 2 and 4, the doll 10 preferably includes at least one moveable arm connected with the body 12. Most preferably, the doll 10 includes first and second arms 30A, 30B, respectively, each moveably attached to the upper portion of the torso 24 at the arm openings 21. Preferably, each arm 30A, 30B is formed of one-piece construction and includes an upper shoulder portion having an opening 15 adapted to be connectable with the body 12 by means of a portion of the mechanism 16, as described below.

Referring now to FIGS. 1 and 2, preferably, the head 22 is generally hollow and has a lower opening 23 extending into the hollow interior, the opening 23 being defined by a circular wall portion 23*a* used to attach the head 22 to the body 12 as described below. The head 22 is preferably formed of single-piece construction, although alternatively it may be formed of two or more pieces joined together (not shown). Further, the head 22 preferably includes hair (not shown) formed of clustered strands of synthetic hair fibers attached to the head 22 by appropriate means and disposed on the outer surface thereof, although alternatively, the hair may be merely molded with and/or painted onto the outer surface of the head 22.

Although the above-described structure of the torso 24, the legs 28A, 28B, the arms 30A, 30B and the head 22 is preferred, it is within the scope of the present invention to construct the any of the above-described components in any other appropriate manner. For example, the legs 28A, 28B may be formed of two or more portions that are slidable with respect to each other or formed of one-piece construction or the arms 30A, 30B made be formed of two moveably-connected portions (none shown). Preferably, the torso 24 and the legs 28A, 28B are molded of a relatively rigid polymeric material, such as for example, high impact polystyrene or polyethylene, and the head 22 and the arms 30A, 30B are preferably molded of a generally pliable polymeric material, such as for example, natural or synthetic rubber. However, it is within the scope of the present invention to construct any one or more of these components of the doll 10 of any other appropriate material.

Referring now to FIGS. 1, 3 and 4, the primary mechanism 16 is connected with the head 22, with each of the legs 28A, 28B and with each of the arms 30A, 30B. The mechanism 16 is configured to displace the legs 28A, 28B frontwardly with respect to the body 12 in alternating succession (i.e., first one leg 28A or 28B and then the other 23B, 28A). The mechanism 16 is also configured to displace the head 22 with respect to the body 12 such that the head 22 moves toward one lateral side 12*c* or 12*d* of the body 12 as one of the legs 28A or 28B displaces frontwardly from proximal to the opposite lateral side 12*d*, 12*c*, respectively, of the body 12. In other words, if the right leg 28B is displacing frontwardly, the head 22 moves toward the left side 12*c* of the body 12, and vice-versa.

As described in further detail below, when the doll 10 is displacing across a surface S in a "walking" configuration (FIG. 1), the torso 12 of the doll 10 is, at any given moment, generally supported above the surface S by only the one leg 28A or 28B that is then contact with the surface S. By moving the head 22 away from the side 12*c* or 12*d* of the body 12 from which one of the legs 28A or 28B is displacing frontwardly (in which case the leg 28A, 28B has been lifted off of the surface S as described below), the head 22 tends to shift the center of mass of the doll 10 toward the other leg 28B, 28A, respectively, which is currently balancing the doll 10 above the surface S. The shifting of the center of mass towards the side 12*c* or 12*d* of the body 12 near which the one leg 28A or 28B is then in contact with the surface S prevents the doll 10 from "toppling" over towards the opposite side of the body 12*d*, 12*c*, respectively. Preferably, the mechanism 16 is also configured to displace the arms 30A, 30B with respect to the body 12. The structure and detailed operation of the primary mechanism 16 is described in detail below.

Preferably, the primary mechanism 16 is disposed mainly within the interior cavity 26 of the torso 24 and, most preferably, the major portions of the mechanism 16 are mounted to the support structure 33 and are enclosed by the cover member (not shown). However, it is within the scope of the present invention to construct the mechanism 16 to be partially, or even completely, disposed externally of the torso 24, such as for example, by attaching the mechanism 16 to the outer surface of one of the torso halves 25A or 25B.

Referring now to FIGS. 3, 4, 6 and 7, the primary mechanism 16 preferably includes a main gear train 34 having an input end 35 and at least one output end, most preferably a first output end 36A connectable with the legs 28A, 28B and a second output end 36B connectable with the arms 30A, 30B. The main gear train 34 further includes a rotatable drive shaft 38 connected with the doll 10. Preferably, the drive shaft 38 extends laterally across the interior cavity 26 of the torso 24 and has two portions that are each disposed within a separate one of the aligned bearing openings 45 of the middle pair of shaft support walls 44C, 44D of the support structure 33. The input end 35 of the main gear train 34 is preferably provided by a crown gear 37 mounted to the drive shaft 38. Preferably, the crown gear 37 is engaged with a pinion gear 96 mounted to the motor shaft 32*a* of the motor 32, such that the main gear train 34 is driven to rotate about the drive shaft axis 38*a* by rotation of the motor 32, as explained in further detail below.

Further, three inner spur gears 40A, 40B, 40C of varying size are mounted to the drive shaft 38 and are coaxial with the input crown gear 37. Preferably, the first inner spur gear 40A is integrally formed with the crown gear 37 and the second and third inner spur gears 40B, 40C are integrally formed together. Alternatively, all four gears 37, 40A–40C may be individual gears separately mounted to the drive shaft 38. The primary gear train 34 further includes two intermediate spur gears 61A, 61B mounted to a common gear shaft 99 that is parallel with, but spaced from, the drive shaft 38. The first intermediate spur gear 61A is engaged with the first spur gear 40A and the second, smaller intermediate spur gear 61B is engaged with the second spur gear 40B. The gear shaft 99 preferably has opposing ends 99*a*, 99*b* that are each disposed within a separate one of the bearing openings 49 of the gear support walls 48A, 48B. Preferably, the two intermediate spur gears 61A, 61B are integrally formed with each other and with the shaft 99, although alternatively, two separate gears may be provided, either on a single shaft or separate shafts, and/or the integral gears may be mounted to a separate shaft (none shown).

Still referring to FIGS. 3, 4, 6 and 7, the main gear train 34 further includes two outer spur gears 39A, 39B are each attached to the drive shaft 38 at separate opposing ends thereof. The left outer gear 39A forms a portion of a leg gear subtrain 42 for rotating the legs 28A, 28B, as described in further detail below. Preferably, each of the outer spur gears 39A, 39B is an integral portion of a composite member 59A, 59B, each composite member 59A, 59B also including integral cam and crank pin portions as described below. Alternatively, the outer spur gears 39A, 39B may be provided by standard spur gears (not shown).

Although the structure of the main gear train 34 as described above and depicted in the drawings is preferred, the main gear train 34 may be constructed in any other appropriate manner that enables the doll 10 to function as described above and below. For example, the main gear train 34 may include more than or less than the eight specified gears (37, 39A, 39B, 40A–40C, 61A, 61B and pinion 96), may include three or more parallel or intersecting gear shafts, and/or may include any desired combination of one or more appropriate types of gears, including spur gears, crown gears, bevel gears, worm gears and planetary gears, depending on the desired train structure.

Referring now to FIGS. 1, 3, 4, 8 and 9, the primary mechanism 16 includes a leg mechanism 98 for moving the legs 28A, 28B with respect to the body 12. The leg mechanism 98 includes a leg shaft 43 rotatable about its central axis 43*a* and connected with at least one of the legs 28A or 28B. Preferably, each leg 28A, 28B is connected with a separate opposing end 43*b* of the leg shaft 43. The leg shaft 43 extends laterally across the interior cavity 26 of the torso 24 and is generally parallel with the drive shaft 38. Further, the leg shaft 43 preferably has two portions thereof that are each disposed within a separate one of the shaft bearing openings 45 of the lower pair of shaft support walls 44E, 44F of the support structure 33.

The leg mechanism 98 further includes the leg gear subtrain 42 mentioned above. Preferably, the leg gear subtrain 42 includes a spur gear 46 mounted to the leg shaft 43 and forming the first output end 36A of the main gear train 34. An intermediate spur gear 47 is disposed between and engaged with the spur gear portion 39A of the left composite gear 59A and the leg spur gear 46. The intermediate spur gear 47 includes an integral shaft 47*a* having one end disposed in the gear bearing opening 73 in the left lower shaft support wall 44E and an opposing end disposed within the gear bearing opening 73 in the outer gear support wall 65 of the support structure 33. The gear shaft 47*a* is also generally parallel with both the drive shaft 38 and with the leg shaft 43.

Although the structure of the leg gear subtrain 42 as described above and depicted in the drawings is preferred, it is within the scope of the present invention to construct the leg gear subtrain 42 in any other appropriate manner, as long as the doll 10 is capable of functioning as described above and below. For example, the leg gear subtrain 42 may be formed with only two spur gears or four or more spur gears or may even be constructed of a combination of an appropriate number of spur gears, bevel gears, worm gears, crown gears and/or any other appropriate type of gear (none shown).

Still referring to FIGS. 1, 3, 4, 8 and 9, the leg mechanism 98 preferably includes two connector assemblies 49A, 49B for connecting the legs 28A, 28B, respectively, to the body 12, specifically to the leg shaft 43. Each connector assembly 49A, 49B includes a clutch plate 53 connected with the leg shaft 43 and a connector plate 55 attached to the respective leg 28A, 28B. The clutch plate 53 has an outwardly-extending circular post 53*a* which extends through a segmented circular sleeve 55*a* of the connector plate 55 such that the connector plate 55 (and thus the leg) is rotatable about an axis 57*a* (FIG. 9) extending through the post 53*a*, as described below. The connector plate 55 further includes a positioning peg 55*b* sized to alternately fit within one of three openings 53*b* (only two shown) spaced about the circular perimeter of the clutch plate 53 so as to maintain the position of the connector plate 55 with respect to the clutch plate 53. The connector assemblies 49A, 49B thus enable the legs 28A, 28B to be positioned in one of three angular orientations with respect to the body 12.

Figure 9:
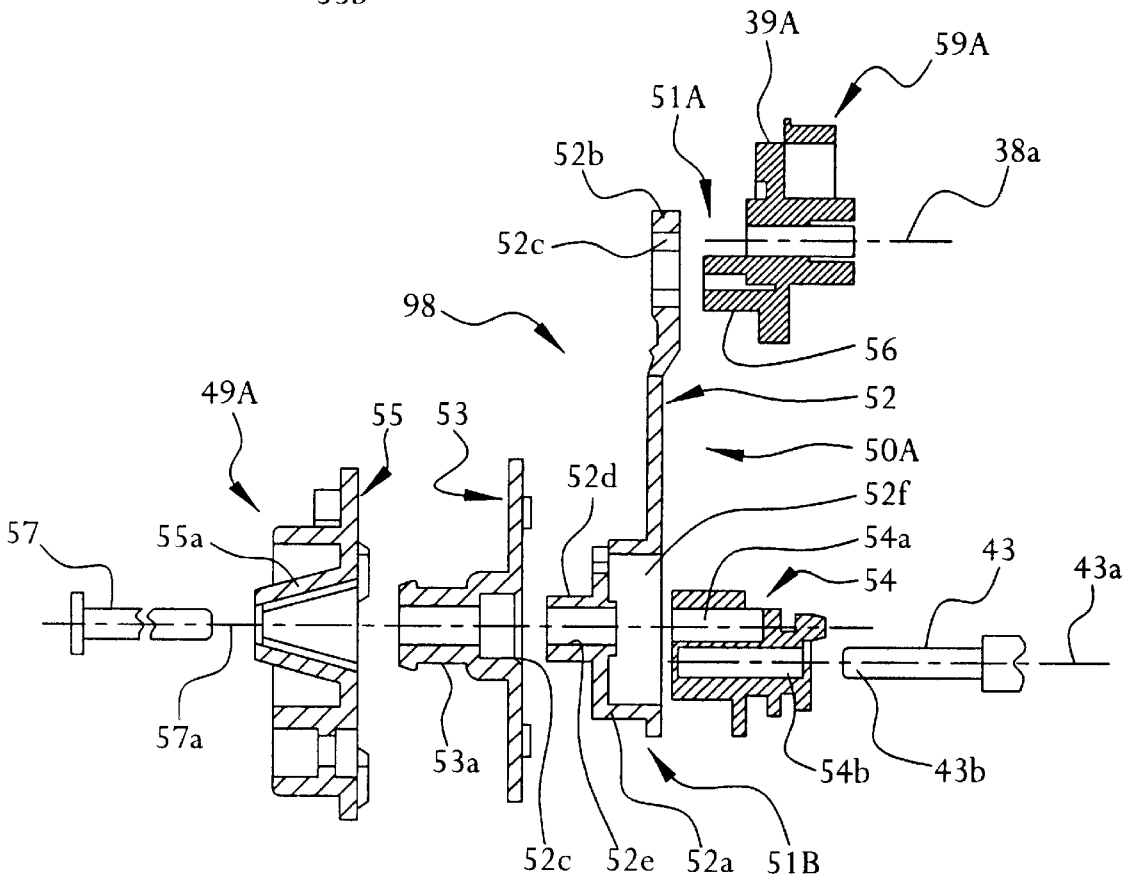
FIG. 9 is an exploded side view in cross-section of the leg assembly and link of FIG. 8, shown with a corresponding composite member and without the leg spur gear.
Figure 10:
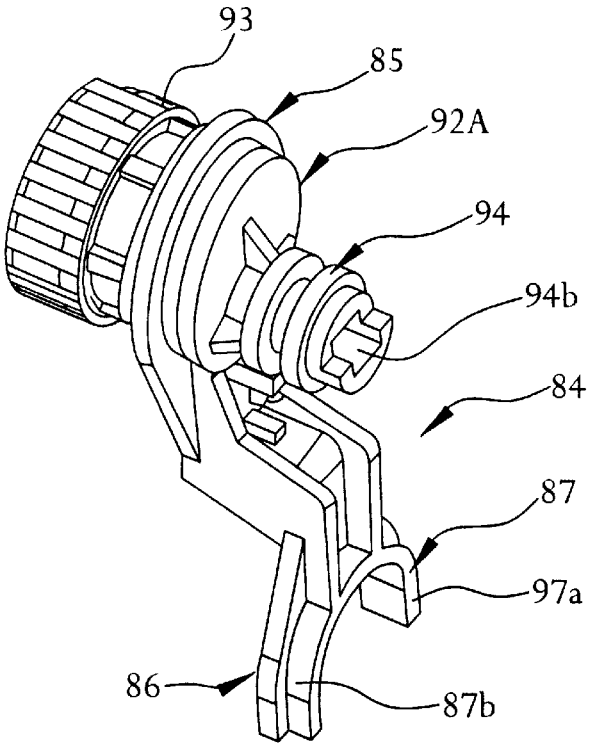
FIG. 10 is a perspective view of an arm connection assembly and associated arm follower.
Figure 11:
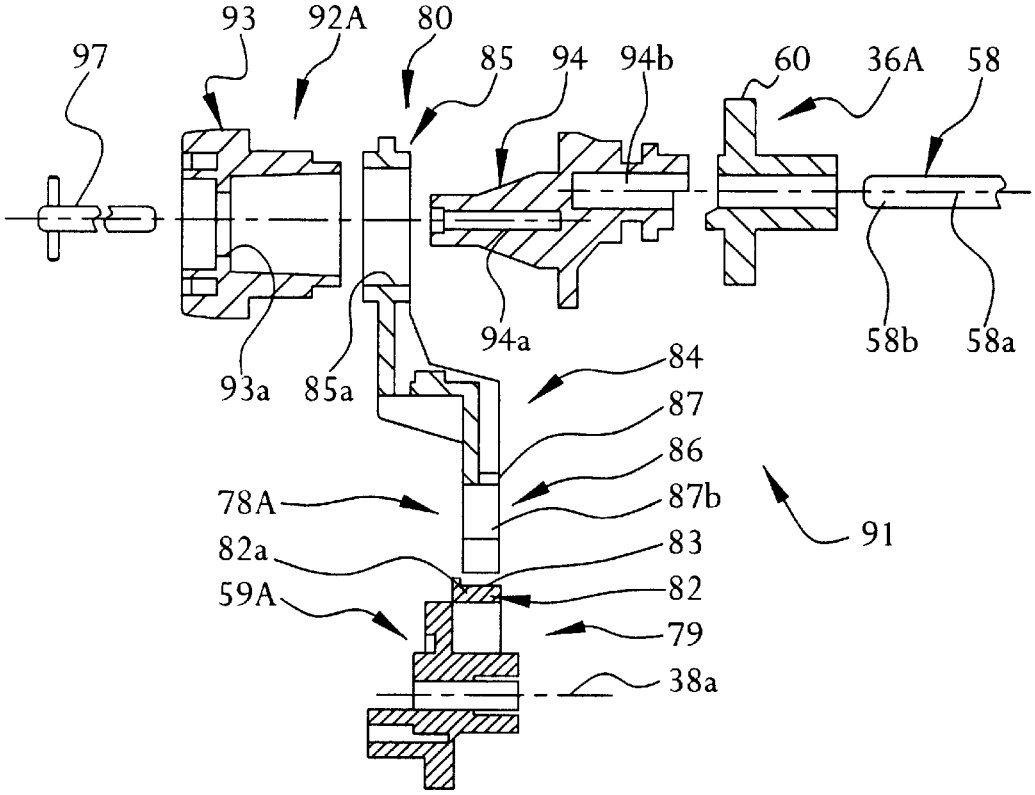
FIG. 11 is an exploded side view in cross-section of the arm assembly and follower of FIG. 11, shown with the arm shaft.
Figure 12:
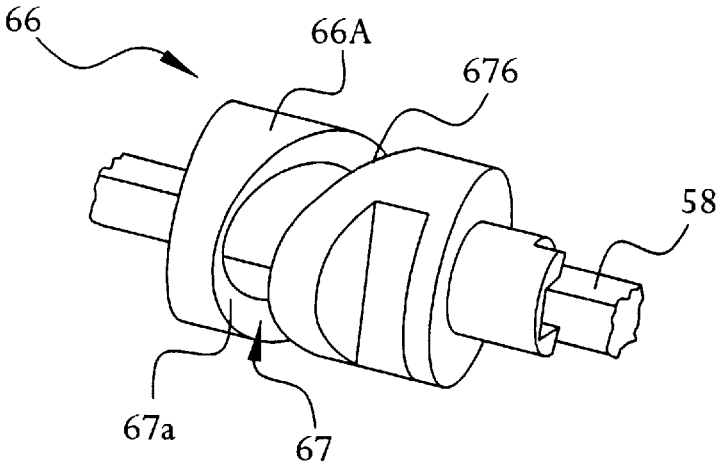
FIG. 12 is a perspective view of a neck cam.
Figure 13:
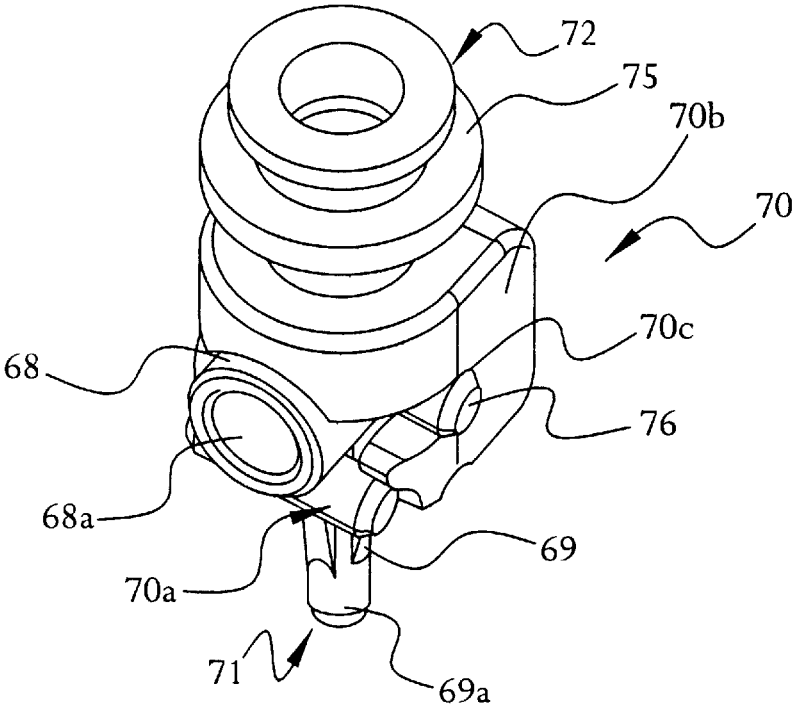
FIG. 13 is a perspective view of a head follower.

Referring particularly to FIG. 9, each connector assembly 49A, 49B further includes a headed shaft 57 (one shown) extending through the post 53*a* of the clutch plate 53. Further, an offset connection member 54 has a first opening 54*a* extending into one side of the member 54, into which is fitted the free end of the headed shaft 57, and a second, generally parallel opening extending into the member 54 from an opposite side, in which is disposed the proximal end of the shaft 43, so as to connect the corresponding connector assembly 49A or 49B to the leg shaft 43. Thus, the headed shaft 57 is parallel with, but offset from, the leg shaft 43. The connector plate 55, and therefore the attached leg 28A or 28B, is freely rotatable about the shaft 57, specifically an axis 57*a* through the shaft 57 that is generally parallel to the leg shaft axis 43*a*.

With the above construction of the connector assemblies 49A, 49B, rotation of the leg shaft 43 causes each connector assembly 49A, 49B (and thus the attached legs 28A, 28B) to move around the leg shaft axis 43*a* in a circular path A while the attached leg 28A, 28B, respectively, generally maintains its orientation relative to the body 12. More specifically, each leg 28A, 28B moves about the leg shaft axis 43*a* in a state motion known to those skilled in the mechanical arts as "curvilinear translation". In other words, although each leg 28A, 28B as a whole is rotating about the shaft axis 43*a,* no part of either leg 28A or 28B turns or pivots with respect to any other part of the same leg 28A, 28B. Thus, if the leg shaft 43 acted upon the legs 28A, 28B independently of other portions of the mechanism 16, the legs 28A, 28B would merely circle about the shaft axis 43*a* without the lower ends of the legs 28A, 28B "lifting" or "falling" with respect to the upper ends of thereof. The above-described effect is due to each leg 28A, 28B being freely rotatable about the shaft axis 57*a* through the respective connector assembly 49A, 49B, which thereby allows gravity to maintain the initial orientation of the leg 28A, 28B with respect to the body 12 as it moves along the circular path.

Further, the two connection members 54 (only one shown) are preferably attached to the leg shaft 43 so as to be spaced 180 degrees with respect to each other about the leg shaft axis 43*a* such that the connector assemblies 49A, 49B are offset to opposite sides of the leg shaft 43 from each other. The effect of the spacing of the connection members 54 about the leg shaft axis 43*a* is to cause one leg 28A or 28B to move rearwardly and upwardly about the shaft axis 43*a* as the other leg 28B or 28B is moving frontwardly and downwardly, and vice-versa, the purpose for which is described below.

Referring now to FIGS. 3, 4, 8 and 9, the leg mechanism 98 further includes at least one leg linkage, and most preferably two leg linkages 50A, 50B each having a first end 51A connected with the drive shaft 38 and a second end 51B (connected with a proximal leg 28A or 28B. The linkages 50A, 50B are each configured to pivot the corresponding leg 28A, 28B in alternate directions with respect to the body 12 of the doll 10, more specifically frontwardly and rearwardly, and vice-versa, as described in further detail below.

In further detail, each linkage 50A, 50B includes a link 52 having a first end 52*a* connected with the clutch plate 53 of the proximal leg 28A or 28B, a second, free end 52*b* and a slotted opening 52*c* disposed proximal to the free end 52*b*. Each link 52 has an outwardly-extending peg 52*d* disposed within an inner open portion 53*c* of the clutch plate 53 so as to connect the link 52 with the plate 53 and a through hole 53*e* through which the shaft 57 extends to the proximal offset connection member 54. Further, a counter-bored open portion 52*f* of each link 52 provides space within which the proximal offset connecting member 54 is rotatable independently of the link 52, as described above and in further detail below.

Still referring to FIGS. 3, 4, 8 and 9, each leg linkage 50A, 50B further includes a crank pin 56 connected with the drive shaft 38 and having a portion disposed within the slotted opening 52*c* of the proximal link 52. Preferably, each crank pin 56 is provided by an integral portion of a separate one of the composite members 59A, 59B that extends laterally outwardly from the spur gear portions 39A, 39B of the members 59A, 59B, respectively. Alternatively, separate crank members (not shown) may be provided, each having a first portion disposed within the slotted opening 52*c* (or otherwise moveably connected with the link 52) and second portion connected with the drive shaft 38. Further, the pins 56 are offset from the drive shaft axis 38*a* so as to move about the axis 38*a* in a circular path as the shaft 38 rotates and are preferably spaced 180 degrees about the axis 38 so as to be disposed on opposite sides thereof.

As each pin 56 moves about the axis 38*a,* it pulls the free end 52*b* of the link 52 in a generally rectangular path about the drive axis 38. The movement of the free end 54*b* of the link 52 about the drive axis 38*a* causes the first end 52*a* of the link 52 to pivot about the leg shaft axis 43*a* (i.e., through the offset connecting member 54), thereby pivoting the connected leg 28A or 28B alternately frontward and backward, and vice-versa, with respect to the body 12. Further, due to the offset connection members 54 being spaced on opposite sides of the leg shaft axis 43*a* and the crank pins 56 being spaced on opposite sides of the drive axis 38*a,* the movement of the links 52 cause one leg 28A, 28B to pivot frontwardly as the other leg 28B or 28B pivots rearwardly, and vice-versa.

The effect of the leg gear subtrain 42 and the linkages 50A, 50B each acting upon the legs 28A, 28B simultaneously is to cause one leg 28A or 28B to be lifted upwardly and pivoted frontwardly with respect to the body 12 as the other leg 28B, 28A moves downwardly and pivots rearwardly, and vice-versa. When the doll 10 is an upright or standing position on a surface S such that the body 12 is supported on the feet 88 (FIG. 1), the doll 10 is displaced by the action of each leg 28A, 28B alternately being lifted off the surface as the leg 28A, 28B circles rearwardly and upwardly by the leg gear subtrain 42 and then pivoted frontwardly by the respective linkage 50A, 50B. The leg 28A, 28B continues to circle frontwardly and downwardly by action of the leg gear subtrain 42 until the respective foot 88 contacts the surface and temporarily supports the body 12 above the surface S, and then the leg 28A, 28B is pivoted rearwardly by the respective linkage 50A, SOB to thereby "pull" the body 12 in the frontward direction. As one leg 28A or 28B is displacing the doll 10 as described, the other leg 28B, 28A is pivoted frontwardly and moved downwardly toward the surface S in above-described manner. The effect of the two legs 28A, 28B alternately and repeatedly lifting upwardly, pivoting frontwardly, moving downwardly, and then pivoting rearwardly is to displace the doll 10 in a manner simulating a human walking motion.

Alternatively, the legs 28A, 28B of the doll 10 may be placed in the bent or crawling position (FIG. 2) as described above such that the doll 10 rests upon the knee portions 17 of the legs 28A, 28B and the hand portions 89 of the arms 30A, 30B. The legs 28A, 28B generally move in the same manner as described above, except that the body 12 is supported by the knees 17 and the hands 89, rather than being balanced on one or both feet 88. The arms 30A, 30B generally act to support the doll 10 as the legs 28A, 28B displace the doll 10, rather than to assist the legs 28A, 28B in displacing the doll 10.

Referring now to FIGS. 1, 3, 4, 10 and 11, the primary mechanism 16 further includes an arm mechanism 91 for moving the arms 30A, 30B with respect to the body 12 of the doll 10. The arm mechanism 91 includes a rotatable arm shaft 58 connected with the body 12. Preferably, the arm shaft 58 extends laterally across the hollow cavity 26 and generally parallel with the drive shaft 38. The arm shaft 58 includes two portions each disposed within a separate shaft bearing opening 45 of the upper pair of shaft support walls 44A, 44B such that the shaft 58 is rotatably supported thereby. At least one arm 30A, 30B is connected with the arm shaft 58 and, lost preferably, each arm 30A, 30B is connected with an opposing end 58*b* of the arm shaft 58 by means of a separate connection assembly as described below.

Referring to FIGS. 3 and 4, the arm mechanism 91 further includes an arm spur gear 60 mounted to the arm shaft 58, which provides another output end 36B for the main gear train 34. The arm spur gear 60 forms part of an arm gear subtrain 41 for driving the arm shaft 58 to rotate about its central axis 58*a*. An intermediate spur gear 62 is disposed between the drive shaft 38 and the arm shaft 58 to complete the arm gear subtrain 41. More specifically, the intermediate gear 62 is engaged with both the third spur gear 41C mounted on the drive shaft 38 and with the arm spur gear 60 mounted on the arm shaft 58. Preferably, the intermediate gear 62 has an integral shaft 62*a* having one end disposed within the second bearing opening 63B in the left gear support wall 63 and an opposing end disposed in the a bearing opening 44*b* in the left shaft support wall 44A. Further, the shaft 62*a* of the intermediate gear 62 is parallel with both the drive shaft 38 and the arm shaft 58.

Referring again to FIGS. 1, 3, 4, 10 and 11, the arm mechanism 91 further includes two arm connector assemblies 92A, 92B for connecting the arms 30A, 30B, respectively, with the arm shaft 58. Each connector assembly 92A, 92B includes a generally cylindrical outer connector member 93 configured to be fitted within the circular opening 15 of the respective arm 30A, 30B so as to be fixedly connected therewith. An inner, offset connector member 94 has a first opening 94*a* extending into one side of the member 94*a* and a second, generally parallel opening extending into the member 94*b* from an opposing side, a headed shaft 97 extends through a through hole 93*a* of each outer connector member 93 and into the first opening 94*a* of the corresponding inner connector member 94 so as to rotatably attach the outer member 93 (and thus the associated arm 30A or 30B) to the inner member 94. Further, each end 58*b* of the arm shaft 58 extends into the second opening of the proximal inner connector member 94 so as to fixedly attach the two connector assemblies 92A, 92B to the arm shaft 58.

With the above-described structure of the arm connector assemblies 92A, 92B, rotation of the arm shaft 58 causes each arm 30A, 30B to move about the arm shaft axis 58*a* in a circular path. As described above with the leg mechanism 98, the arm gear subtrain 41 tends to move each arm 30A, 30B in a circular path about the axis 58*a* without turning or pivoting the arm 30A, 30B with respect to itself (i.e., curvilinear motion). In other words, if the arm shaft 58 acted upon the arms 30A, 30B independently of other portions of the primary mechanism 16, the arm shaft 58 would move the arms in a continuous "shrugging" type of motion without the lower ends of the arms 30A, 30B lifting or falling with respect to the upper ends of thereof.

However, as opposed to the movement of the legs 28A, 28B established by the preferred configuration of the leg connector assemblies 49A, 49B, the inner connector members 94 are preferably each attached to the arm shaft 58 so as to be generally disposed on the same side of the shaft axis 58*a*. Thus, each arm 30A, 30B moves along its circular path such that both arms 30A, 30B are moving rearwardly and upwardly, then frontwardly and downwardly, and vice-versa, generally simultaneously with each other.

Referring now to FIGS. 3, 4, 10 and 11, the arm mechanism 91 further includes at least one arm linkage, and preferably two arm linkages 78A, 78B each having a first end 79 connected with the drive shaft 38 and a second end 80 connected with the arm shaft 58. The linkages 78A, 78B are each configured such that rotation of the drive shaft 38 causes the linkages 78A, 78B to pivot each arm 30A, 30B, respectively, in alternate directions about the arm shaft axis 58*a*. Preferably, each arm linkage 78A, 78B includes a cam 82 mounted to the drive shaft 38 and a follower 84 having a first end 85 connected with the respective arm 30A, 30B and a second, free end 86 engaged with the respective cam 82.

Figure 7:
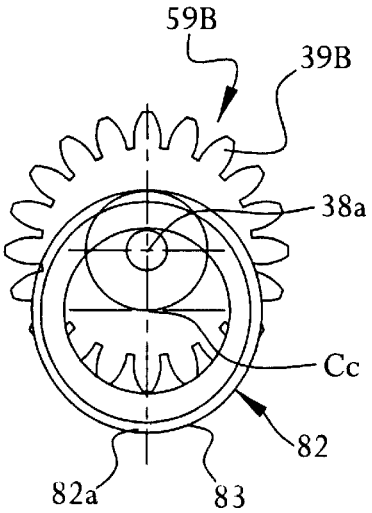
FIG. 7 is a view through line 7—7 of FIG. 6.
Figure 8:
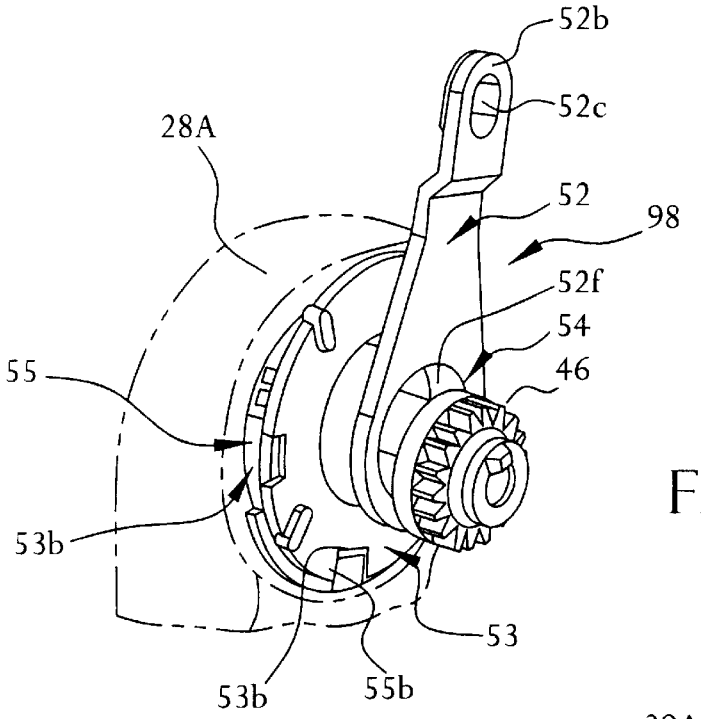
FIG. 8 is a perspective view of a leg connection assembly and an associated leg link.

Preferably, each cam 82 is provided by a generally circular ring portion of the proximal one of the composite members 59A, 59B, although a separate, individual cam (not shown) mounted to the drive shaft 38 may alternatively be provided. Each cam 82 has an outer circumferential surface defining an eccentric cam surface 83. More specifically, as best shown in FIG. 7, the circumferential cam surface 83, although generally circular, has a center $C_c$ that is offset from the drive shaft axis 38*a* such that the cam surface 83 is eccentric with respect to the drive shaft 38.

Further, each follower 84 is preferably constructed as a link having an enlarged circular portion at the upper, first end 85 and an inwardly-offset portion providing the second, free end 86. The upper circular portion of each follower 84 includes a circular through hole 85*a* which is disposed about a stepped circumferential portion 93*b* of the proximal outer connector member 93 so as to fixedly attach the follower 84 to the outer connector member 93, and thus to the corresponding arm 30A or 30B. Each follower 84 further includes a spring-loaded retainer (not shown) separately engagable with either of two openings (not shown) in the cuter connector member, thereby enabling the arm to be positioned in one of two orientations with respect to the torso 24.

Further, the free end 86 of each follower 84 preferably includes a yoke or yoke-shaped portion 87 that is disposable about at least a portion of the cam surface 83 of the associated member 59A, 59B. Most preferably, each yoke 87 has arms 87*a*, 87*b* that are disposed on opposite sides of the associated cam 82 such that as the cam 82 rotates, the radially-outermost portion 82*a* of the cam 82 first pushes against one arm 87*a* to pivot the proximal follower 84 in one direction (e.g., frontwardly) and then continues to rotate until pushing against the other arm (e.g 87*b*) so as to pivot the follower 84 in the opposite direction (e.g. rearwardly).

Thus each cam 82 pivots the associated the follower 84 about the arm shaft axis 38*a* in a first rotational direction (e.g., clockwise) and then in a second, opposing direction (e.g., counterclockwise) for each revolution of the drive shaft 38. As each follower 84 is pivoted in alternate directions, the follower 84 causes the connected arm 30A or 30B to pivot in alternating directions with respect to the torso 24, such that the arms 30A, 30B "swing" frontwardly, then rearwardly, and vice-versa.

Figure 6:
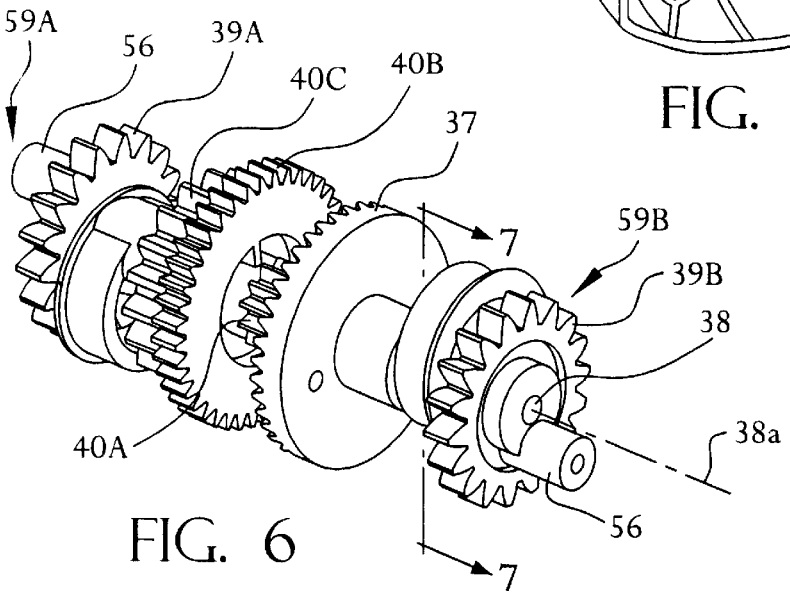
FIG. 6 is a perspective view of a drive shaft with an attached portion of a gear train.

Further, as best shown in FIG. 6, the composite members 59A, 59B are preferably arranged on the drive shaft 38 such that the radially outermost portion of each cam 82 is disposed on an opposite side of the drive shaft axis 38*a*. With this arrangement, one cam 82 causes the proximal follower 84 to pivot the associated arm (e.g., 30A) frontwardly as the other cam 82 causes its proximal follower to pivot the associated arm (e.g., 30B) rearwardly, and vice-versa.

Referring again to FIGS. 3, 4, 10 and 11, the combined effect of the arm gear subtrain 41 and the arm linkages 78A, 78B acting simultaneously upon the arms 30A, 30B is to move the arms 30A, 30B in the following manner for each revolution of the arm shaft 58. First, the two arms 30A, 30B both move rearwardly and frontwardly along the circular path about the arm shaft axis 58*a* as one arm (e.g. 30A) pivots frontwardly with respect to the body 12 and the other arm (e.g., 30B) pivots rearwardly with respect to the body 12. Then, both arms 30A, 30B continue to move along the circular path downwardly and frontwardly as the one arm (e.g. 30A) pivots rearwardly and the other (e.g., 30B) pivots frontwardly. The arms 30A, 30B repeat the above-described set of movements for every revolution of the arm shaft 58.

Referring now to FIGS. 3, 4, 12 and 13, the primary mechanism 16 further includes a head mechanism 95 configured to move the head 22 laterally with respect to the body 12 of the doll 10. The head mechanism 95 includes a cylindrical cam 66 mounted to the arm shaft 58 and having a cylindrical body 66*a*. The cylindrical body 66*a* of the cam 66 has an outer surface and an annular opening extending into the body from the outer surface that is bounded by two radial walls 67*a*, 67*b* that define a cam surface 67. The cam surface 67 extends completely about the circumference of the body 66*a* and winds axially or laterally with respect to the body 66*a* so as to impart an oscillating lateral motion to a follower as described below.

Further, the head mechanism 95 preferably includes a rotatable neck shaft 68 that is connected with the body 12 of the doll 10. Preferably, the neck shaft 68 extends between the neck portions 27A, 27B of the torso halves 25A, 25B, respectively and generally perpendicular to and above the arm shaft 58. a moveable follower 70 is mounted to the neck shaft 68 and has a first end 71 contactable with the cam surface 67 of the cylindrical cam 66 and a second end 72 connected with the head 22 of the doll 10.

Preferably, the follower 70 is integrally formed with the neck shaft 68. The neck shaft 68 preferably includes two open ends 68*a* (only one shown) into each of which extends a proximal one of a pair of aligned pins 74 that extend inwardly from the opposing inner surfaces of the neck portions 27A, 27B of the torso halves 25A, 25B. The neck shaft 68, and therefore the neck follower 70 and connected head 22, are rotatable upon the pair of pins 74. a tapered or conical pin 69 extends from the integral shaft portion 68 to terminate in a relatively narrow rounded end portion 69*a* at the first end 71 of the follower 70. The rounded end portion 69*a* is sized to fit between the pair of walls 67*a*, 67*b* defining the cam surface 67 of the cam 66, as shown in FIGS. 3 and 4.

Further, the follower 70 is preferably formed of two-piece construction consisting of a lower portion 70*a*, including the neck shaft 68 and integral follower pin 69, and a second, upper portion 70*b* including a cylindrical neck post 75 at the second end 72 of the follower 70. The upper portion 70*b* is preferably joined to the lower portion 70*a* by means of an joining pin 76 that is integral with and perpendicular to the neck shaft 68 and which is removably disposed within a pair of aligned openings 70*c* in the upper portion 70. However, the follower 70 may alternatively be formed of one-piece construction (not shown) or of three or more pieces (not shown) removably or permanently attached by any appropriate means, such as for example, adhesive substances or threaded fasteners. Further, the upper portion 70*b* of the follower 70 is preferably pivotable with respect to the lower portion 70*a* by rotating the upper portion 70*b* about the joining pin 76. By pivoting the upper portion 70*b*, the head 22 is positionable between a first position (FIG. 1), in which the head 22 is generally aligned with the front and rear sides 12*a*, 12*b*, respectively, of the body 12, and a second, position (FIG. 2), in which the head 22 is "tilted" toward the rear side 12*b* of the body 12.

With the above-described structure of the head mechanism 95, rotation of the arm shaft 58 causes the head 22 to laterally displace with respect to the body 12 of the doll 10. More specifically, rotation of the arm shaft 58 rotates the cam 66 about the arm shaft axis 58*a* such that the cam surface 67 moves around the axis 58*a*. As the cam surface 67 moves about the axis 58*a*, the walls 67*a*, 67*b* of the cam 66, which "wind" from one lateral side of the cam 66 to the other, and back again, push against the end 71 of the follower 70 and cause the end 71 to also move laterally from side-to-side. The alternating lateral movement of the first end 71 of the follower 70 pivots the follower 70 about the neck shaft 68 such that the head 22 is moved to the lateral side 12*c* or 12*d* of the body 12 opposite the side 12*d*, 12*c* towards which the follower 70 is moving. Preferably, the cam surface 67 is configured such that one rotation of the arm shaft 58*a* (and thus the cam 66) moves the head 22 from an initial position with respect to the body 12 (preferably centered thereto) toward one side 12*c* or 12*d*, then toward the other side 12*d*, 12*c*, and finally back to the initial position.

Preferably, the various above-described components of the mechanism 16, such as the gears, links, followers, cams, etc., are each molded of a rigid polymeric material, such as for example, Delren or high impact polystyrene, with the exception of the shafts 38, 43 and 58, which are preferably cut from metallic bar stock, such as aluminum or steel. However, it is within the scope of the present invention to construct any of the components of the primary mechanism 16 of any other appropriate material by any other appropriate process, such as for example, by forming the gears of stamped aluminum.

Figure 14:
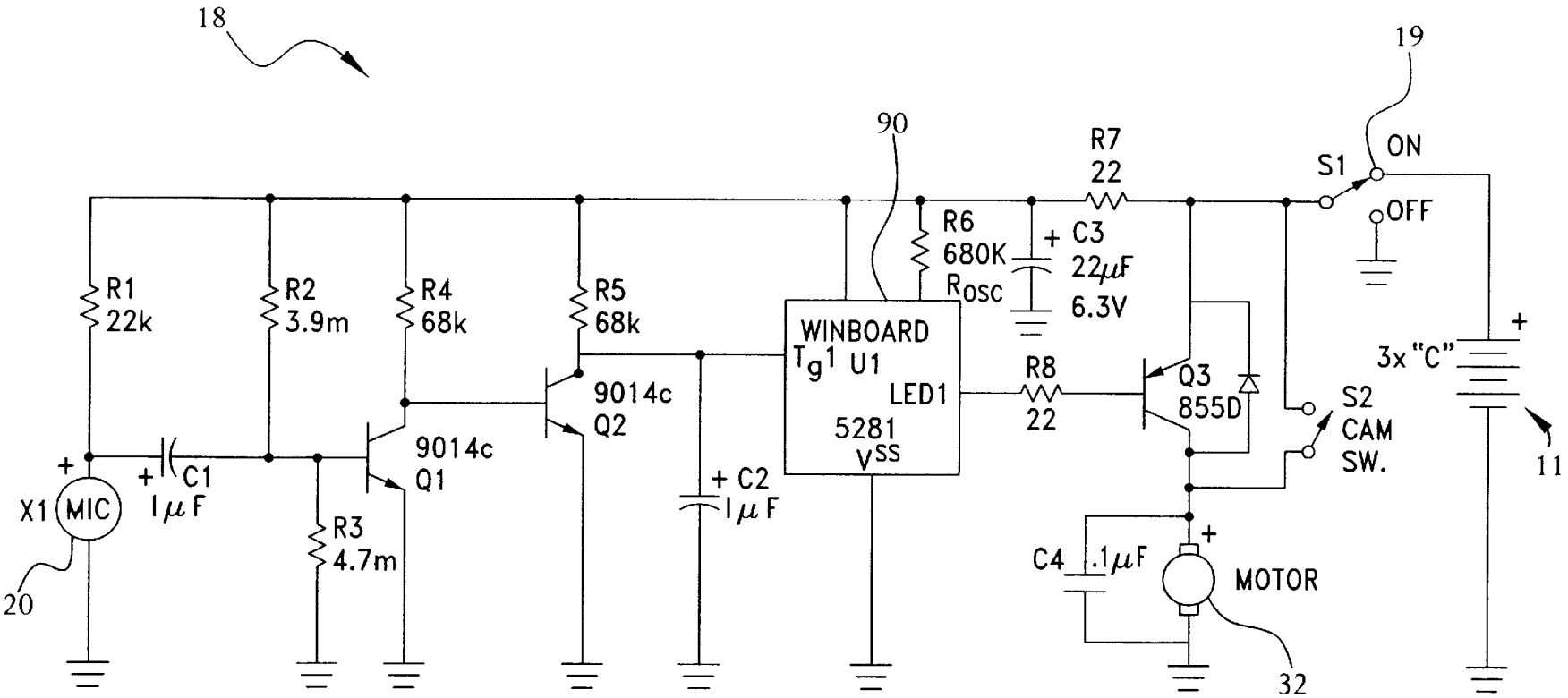
FIG. 14 is a schematic diagram of an electrical circuit suitable for driving the doll of the present invention.

Referring now to FIG. 14, the electrical circuit 18 is preferably configured as depicted in the schematic diagram of FIG. 14. However, those skilled in the electronics arts will recognize that the electrical circuit 18 may be constructed in numerous alternative configurations that are capable of performing the functions described herein. The present invention is intended to embrace all alternative configurations of the electrical circuit 18 that enable the doll 10 to function as described above and below. Although a detailed recitation of the structure of the electrical circuit 18 is beyond scope of the present disclosure, certain important elements of the circuit 18 are described below.

Specifically, as stated above, the circuit 18 includes a microphone 20 for receiving sounds, particularly sounds generated by a user of the doll 10. The electrical circuit 18 is configured to drive the mechanism 16 in response to a sound received by the microphone 20 such that the mechanism 16 displaces at least one appendage 14 with respect to the body 12 so that the appendage displaces the body 12 of the doll 10. Preferably, the electrical circuit 18 is disposed completely within the interior cavity 26 of the torso 24 except for an externally-exposed "on-off" switch 19 (shown only diagrammatically) accessible to the user. Alternatively, the electrical circuit 18 be disposed partially or completely externally of the torso 24 and may even have portions unattached to the body 12 of the doll 10.

Preferably, as mentioned above, the doll 10 includes a motor 32 electrically connected with the electrical circuit 18 and with the mechanism 16 such that the electrical circuit drives the motor 32 and the motor 32 drives the mechanism 16. More specifically, the electrical circuit 18 is configured to connect the motor 32 to the power source 11 i.e., the batteries-not shown) when the microphone 20 receives a sound (preferably a user-generated command). The connection of the motor 32 to the power source 11 causes the motor shaft 32*a* to rotate, causing the pinion gear 96 to drive the drive shaft 38 and thereby drive the various portions of the mechanism 16 as described above.

Preferably, the motor 32 is a typical permanent magnet, direct-current motor, although alternatively the motor 32 may be any other appropriate type of motor, such as a wound coil motor operated by alternating current. Further, it is within the scope of the present invention to include another appropriate means to drive the mechanism 16, such as, for example, a solenoid, a pneumatic motor, a hydraulic system, or any other appropriate means by which the electrical circuit 18 may drive the mechanism 16 in response to sounds received by the microphone 20.

Still referring to FIG. 14, preferably, the electrical circuit 18 includes an integrated circuit 90 connected with the microphone 20 and with the mechanism 16 (i.e., through the motor 32) such that the integrated circuit 90 receives signals from the microphone 20 and transmits signals to drive the mechanism 16. More specifically, the microphone 20 receives sounds, preferably generated by user, and converts the sounds to electrical signals and transmits the electrical signals to the integrated circuit 90, such that the integrated circuit 90 sends an electrical control signal to the motor 32 causing the motor shaft 32*a* to rotate and drive the drive shaft 38.

Further, the integrated circuit 90 is preferably configured to drive the motor 32 for a randomly selected one of a specified number of predetermined intervals of time in response to a sound received by the microphone 20. In other words, the integrated circuit 90 randomly selects a control signal in response to sound received by the microphone 20 and then transmits the selected signal such that the motor 32 is connected with the power source 11 for only the predetermined interval of time, and then the power source 11 is disconnected from the motor 32. Thereby, the mechanism 16 is driven only for the specified interval of time, and thus, the movement of the head 22, the legs 28A, 28B and the arms 30A, 30B with respect to the body 12 occurs only for the specified duration of the time interval. Further, each of the predetermined time intervals preferably have a time duration different than the other intervals.

However, it is within the scope of the present invention to construct the electrical circuit 18 without an integrated circuit chip. In such an alternative configurations, the electrical circuit 18 may be configured such that the motor 32 is connected with the power source 11 for only one specific interval of time (for example, by using a mechanical switch-not shown) or receives power indefinitely until the microphone 20 receives another sound to thereby cause the circuit 18 to disconnect the power source 11 from the motor 32.

Furthermore, the integrated circuit 90 is preferably a commercially available IS chip mounted on a circuit board (not shown) disposed within a lower portion of the interior cavity 26 of the torso 24, although the circuit board 91 may be alternatively positioned at any other appropriate location within the cavity 26 or even externally of the torso 24. Further, the microphone 20 is preferably a commercially available microphone and is preferably attached to the inner surface of the front torso half 25A proximal to the upper, neck portion 27A of the front torso half 25A. Alternatively, the microphone 20 may be attached at any other appropriate location on the doll 10, although preferably at some location on the front torso half 25A to facilitate reception of user-generated sounds or audio signals. Furthermore, the integrated circuit 90 is connected with the microphone 20 and with the motor 32 by appropriate means, such as, for example, sets of conductive wiring.

In use, the doll 10 is operated in one of two possible modes of displacement, depending on the positioning of the legs 28A, 28B and the arms 30A, 30B with respect to the body 12. In the crawling mode shown in FIG. 2, the arms 30A, 30B are positioned in a more forward or upper configuration by positioning each arm 30A, 30B generally frontwardly and upwardly with respect to the body 12 by using the detent mechanism as described above. Further, the legs 28A, 28B are folded into the bended configuration and the upper portions 29 are positioned generally frontwardly with respect to the body 12 by adjusting the position of the leg connector plate 55 with respect to the leg clutch plate 53 as described above, such that the legs 28A, 28B are oriented generally angularly with respect to the body 12. The doll 10 id then placed on a surface S such that the body 12 is supported above the surface on the hand portions 89 of the arms 30A, 30B and the knee portions 17 of the legs 28A, 28B.

With the doll 10 positioned on the surface S in the crawling mode, a user generates a sound, such as by clapping or speaking an appropriate phrase such as for example "come here", "here baby", etc. If the user-generated sound of sufficient amplitude (i.e., loud enough) to be received by the microphone 20, the microphone 20 sends an electrical signal to the electrical circuit 18, specifically the integrated circuit 90, such that the circuit 18 sends a control signal to the motor 32 to drive the mechanism 16. The mechanism 16 causes the legs 28A, 28B to displace frontwardly in alternate succession, such that the legs 28A, 28B "pull" the doll 10 along the surface S. Simultaneously, the arms 30A, 30B displace frontwardly with respect to the body 12 and downwardly into contact with the surface S in alternate succession such that the arms 30A, 30B maintain the body 12 supported above the surface S to prevent the doll 10 from tipping forward upon the head 22. Although the head 22 displaces laterally as described above, the displacement of the head 22 is generally for the purpose of enhancing the simulation of the movement of a human child and does not otherwise contribute to displacing the doll 10.

The doll 10 preferably continues to crawl across the surface S until the expiration of the predetermined time interval selected by the integrated circuit 90, at which time the motor 32 is disconnected from the power supply (not shown) end the mechanism 16 ceases to drive the legs 28A, 28B. The doll 10 then rests upon the surface S in the "all-fours" crawling configuration until the user generates another audio command signal to re-initiate the crawling mode.

In the "walking" mode shown in FIG. 1, the legs 28A, 28B must first be positioned in the straightened configuration. If not already so configured, the lower portion 31 of each leg 28A, 28B is pivoted with respect to the connected upper portion 29 until the two portions are generally aligned. Further, each leg 28, 28B is oriented so as to be generally vertically aligned with the torso 24 by adjusting the respective connector plate 55 with respect to the associated clutch plate 53 in the manner described above. Further, each arm 30A, 30B is preferably positioned so as to be extend generally frontwardly and downwardly with respect to the torso 24 using the adjusting means described above. However, the doll 10 may also "walk" with the arms 30A, 30B in the more upward position used in the crawling mode and shown in FIG. 2.

With at least the legs 28A, 28B positioned as described, the doll 10 is placed upon a surface S so as to be generally supported on the feet 88 in the generally erect standing position shown in FIG. 1. a user then generates a sufficiently "loud" sound as described above, such that the mechanism 16 drives the legs 28A, 28B to repeatedly displace alternately and in succession, as described above, such that the legs 28A, 28B displace the doll 10 across the surface S by executing a series of forward steps. Simultaneously, as described above, the head 22 is repeatedly displaced toward the lateral side 12*c*, 12*d* of the body 12 opposite that from which one of the legs 28A or 28B is then displacing frontwardly to balance the doll 10 on the foot of the other leg 28B, 28A that is then currently in contact with the surface. After the frontwardly-displacing leg 28A or 28B contacts the surface S, the other leg 28A, 28B is then pivoted frontwardly while the head 22 simultaneously displaces in the opposite direction toward the other lateral side 12*d* or 12*c* of the body 12. During the walking mode, the arms 30A, 30B displace with respect to the body 12 in the manner described above, but do not contribute to displacing the doll 10 other than to enhance the simulation of a real human child walking across the surface S.

As described above, the doll 10 preferably continues to walk across the surface S until the expiration of the predetermined time interval selected by the integrated circuit 90, at which time the motor 32 is disconnected from the power supply (not shown) and the mechanism 16 ceases to drive the legs 28A, 28B. The doll 10 then rests upon the surface S in the standing configuration until the user generates another audio command signal to re-initiate the walking mode.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A doll comprising:

a body having a frontward side and first and second lateral sides;

a head movably attached to the body;

a first leg movably attached to the body proximal to the first lateral side of the body;

a second leg movably attached to the body proximal to the second lateral side of the body; and a mechanism connected with the head and with each of the legs and configured to displace the legs frontwardly with respect to the body in alternating succession and to displace the head in lateral directions with respect to the body such that the head moves toward one of the lateral sides of the body as one of the legs displaces frontwardly from proximal the opposite lateral side of the body, the mechanism further comprising a rotatable drive shaft connected with the doll; and a linkage having a first end connected with the drive shaft and a second end connected with one of the legs and configured to pivot the connected leg between a first position with respect to the body and a second position with respect to the body as the drive shaft rotates, the linkage further comprising a link having a first end connected with the leg, a second free end and a slotted opening proximal to the second end; and a crank pin connected with the drive shaft and having a portion disposed within the slotted opening such that rotation of the drive shaft moves the pin within the slotted opening to drive the leg to oscillate in alternate directions with respect to the body.

2. The doll as recited in claim 1 further comprising at least one arm movably attached to the body and connected with the mechanism such that the mechanism displaces the arm with respect to the body.

3. The doll as recited in claim 1 further comprising a motor connected with the mechanism, the motor driving the mechanism to displace the legs and the head.

4. The doll as recited in claim 3 further comprising an electrical circuit connected with the motor, having a microphone and configured to drive the motor when the microphone receives sound.

5. The doll as recited in claim 4 wherein the electrical circuit includes an integrated circuit chip.

6. A doll comprising:

a body having a frontward side and first and second lateral sides;

a head movably attached to the body;

a first leg movably attached to the body proximal to the first lateral side of the body;

a second leg movably attached to the body proximal to the second lateral side of the body; and a mechanism connected with the head and with each of the legs and configured to displace the legs frontwardly with respect to the body in alternating succession and to displace the head in lateral directions with respect to the body such that the head moves toward one of the lateral sides of the body as one of the legs displaces frontwardly from proximal the opposite lateral side of the body, the mechanism further comprising a rotatable drive shaft connected with the body; an arm shaft connected with the body, the arm being mounted to the arm shaft, and a linkage having a first end connected to the drive shaft and a second end connected with the arm shaft and configured to pivot the arms with respect to the body as the drive shaft rotates, the linkage further comprising a cam having a cam surface extending about the plate eccentrically mounted to the drive shaft; and a follower link having a first end connected with the arm shaft and a second, free end contactable with the cam surface such that rotation of the drive shaft rotates the cam plate to cause the arm to pivot in alternate directions.

7. A doll comprising:

a body having a frontward side and first and second lateral sides;

a head movably attached to the body;

a first leg movably attached to the body proximal to the first lateral side of the body;

a second leg movably attached to the body proximal to the second lateral side of the body; and a mechanism connected with the head and with each of the legs and configured to displace the legs frontwardly with respect to the body in alternating succession and to displace the head in lateral directions with respect to the body such that the head moves toward one of the lateral sides of the body as one of the legs displaces frontwardly from proximal the opposite lateral side of the body; and wherein the legs are foldable to enable the doll to displace in a walking mode when the legs are disposed in a first configuration and in a crawling mode when the legs are disposed in a second configuration.

8. A doll movable in response to sounds generated by a user, the doll comprising:

a body;

at least one appendage movably attached to and configured to displace the body;

a mechanism connected with the appendage and configured to displace the appendage with the respect to the body; and an electrical circuit electrically connected with the mechanism, having a microphone and configured to drive the mechanism in response to a sound received by the microphone such that the mechanism displaces the appendage with respect to the body to cause the appendage to displace the doll, the mechanism further comprising a motor having a rotatable motor shaft;

a gear train having an input end connected with the motor shaft and an output end;

a drive shaft connected with the output end of the gear train;

a leg shaft having opposing ends, each of the legs being mounted to a separate one of the ends of shaft;

a linkage having a first end connected with the drive shaft and a second end connected to the leg shaft such that rotation of the motor shaft displaces the legs with respect to the body;

an arm shaft having opposing ends, each arm being mounted a separate one of the ends of the shaft, and another linkage having a first end connected with the drive shaft and second end connected with the arm shaft such that rotation of the motor shaft displaces the arms with respect to the body, the linkage further comprising a cam connected to the drive shaft; and a follower having a first end contactable with the cam and a second end connected with the arm shaft such that rotation of motor shaft causes the arms to displace between a frontward position with respect to the body and a rearward position with respect to the body.

9. The doll as recited in claim 8 wherein the electrical circuit includes an intergrated circuit connected with the microphone and with the mechanism such that the integrated circuit receives signals from the microphone and transmits signals to the mechanism.

10. The doll as recited in claim 8 wherein the body includes four of the appendages attached to the body, two appendages being legs rotatably attached to the body and two appendages being arms rotatably attached to the body, each of the appendages being displaceable with respect to the body by the mechanism.

11. A doll comprising:

a body;

a rotatable drive shaft connected with the body;

a cam mounted to the drive shaft;

a rotatable arm shaft connected with the body;

at least one arm mounted to the arm shaft; and a follower mounted to the arm shaft and having a first end contactable with the cam such that rotation of the drive shaft causes the follower to pivot the arm in alternating directions with respect to the body.

12. The doll as recited in claim 11 wherein the arm shaft has a first axis of rotation and the arm is rotatable about a second axis of rotation offset from the first axis such that the rotation of the drive shaft causes the arm to move in a circular path about the arm shaft axis.

13. The doll as recited in claim 11 further comprising a motor having a motor shaft connected with the drive shaft such that the motor drives the arm shaft to pivot the arm.

14. The doll as recited in claim 11 wherein:

the cam has an outer circumferential surface defining an eccentric cam surface; and the follower has a yoke-shaped portion at the first end, the yoke-shaped portion being contactable with at least a portion of the cam surface such that rotation of the cam acts upon the yoke-shaped portion to pivot the arm in alternate directions with respect to the body.

* * * * *